United States Patent [19]

Malmstrom

[11] Patent Number: 4,923,247

[45] Date of Patent: May 8, 1990

[54] CUSHION WITH MESSAGE SLOT

[76] Inventor: Carey D. Malmstrom, 2126 LaVista Cir., Tucker, Ga. 30084

[21] Appl. No.: 257,730

[22] Filed: Oct. 14, 1988

[51] Int. Cl.[5] ..... A47C 27/10

[52] U.S. Cl. ..... 297/4; 5/457; 40/586

[58] Field of Search ..... 297/4, 438, DIG. 8; 2/48, 49 R, 244; 40/640, 649, 586; 5/441, 457, 449

[56] References Cited

U.S. PATENT DOCUMENTS

| | | | |
|---|---|---|---|
| 1,468,072 | 9/1923 | Ogle | 297/4 |
| 2,446,006 | 7/1948 | Hendricks | 297/4 |
| 2,596,884 | 5/1952 | Bailen | 40/640 |
| 2,829,386 | 4/1958 | Peer | 297/4 |
| 3,540,776 | 11/1970 | Wilson | 297/4 |
| 4,177,587 | 12/1979 | Dorsen et al. | 40/649 |
| 4,637,151 | 1/1987 | Love et al. | 40/586 |
| 4,679,262 | 7/1987 | Davis et al. | 247/391 |

*Primary Examiner*—Kenneth J. Dorner
*Assistant Examiner*—Brian K. Green
*Attorney, Agent, or Firm*—James B. Middleton

[57] ABSTRACT

A cushion is inflatable, and includes straps to attach the cushion to a person to cover the buttocks of the person, so the cushion stays on the person while the person is standing, and is in place for sitting. The cushion has waist straps at the upper portion of the cushion; and, the lower portion of the cushion is bifurcated with two leg portions to cover the upper portion of the thighs. The upper portion of the cushion has a slot to receive a bumpersticker that is visible while the person is wearing the cushion. The cushion is made from plastic sheet, and the sheet towards the wearer has a flocked surface for improved comfort.

2 Claims, 1 Drawing Sheet

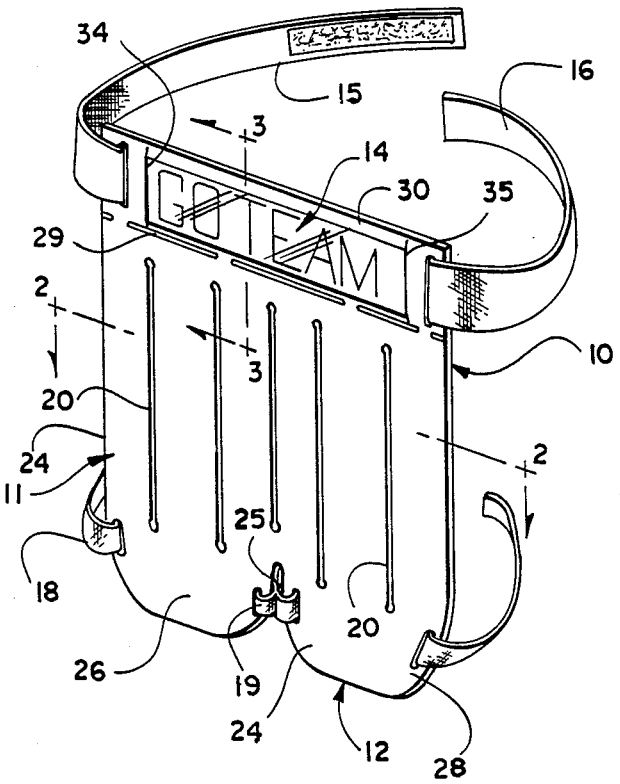
Fig. 3
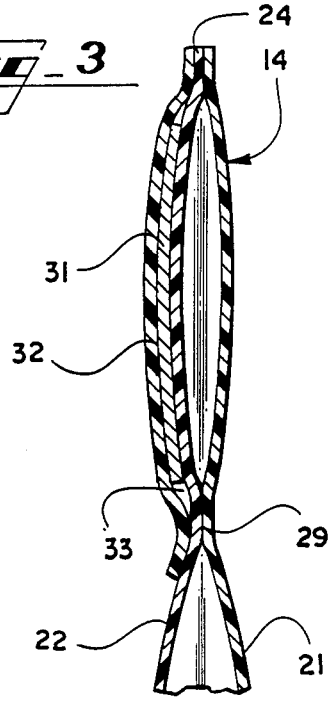
Fig. 2
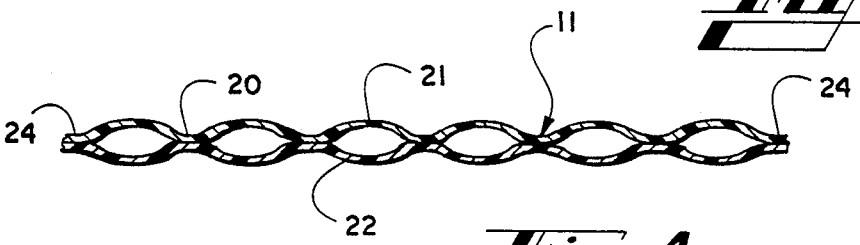
Fig. 4
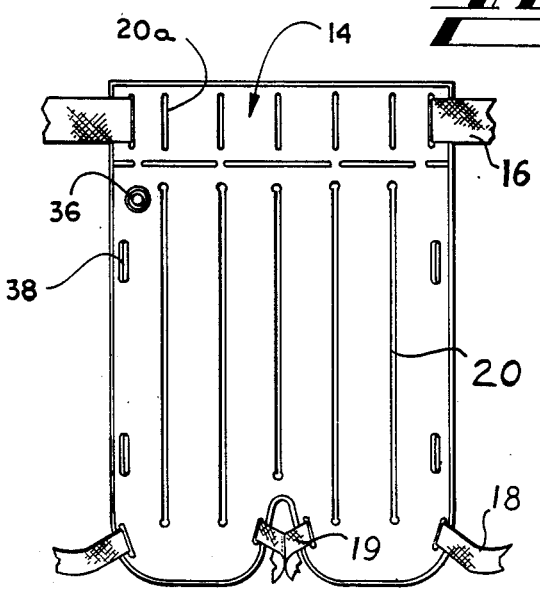
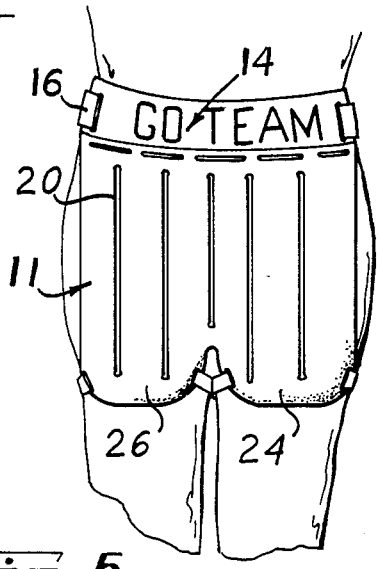
Fig. 5

CUSHION WITH MESSAGE SLOT

INFORMATION DISCLOSURE STATEMENT

There is a constant problem in providing seat cushions for outdoor occasions. The prior art includes numerous sports cushions and the like, such prior art cushions generally including padding having a carrying handle for convenient transport. While such cushions will provide a relatively soft seat, the cushions are somewhat troublesome in that the cushion remains on the seat while the user may wish to be somewhat active. Thus, the conventional cushion may be displaced, and perhaps lost, while the user is standing. Also, a cushion made from foam or other padding usually occupies a rather significant volume, and is difficult to fold or otherwise compress into a small space. The prior art does include some inflatable cushions, but the inflatable cushions are usually so light in weight that they are very easily displaced and lost; and, many inflatable cushions either have the improper shape for comfortable sitting, or are designed to be an integral part of the seat so they are not readily transportable.

SUMMARY OF THE INVENTION

This invention relates generally to seat cushions, and is more particularly concerned with a body mounted, inflatable seat cushion.

The present invention provides an inflatable cushion adapted to cover the general area of a person's buttocks, and extending somewhat into the person's legs so that the entire seating area of the person is covered by the cushion. The cushion of the present invention includes a waist strap for fixing the cushion to the person generally at or below the waist, and leg straps for individually fixing portions of the cushion to the legs of the user. The cushion of the present invention includes a plurality of seams, the seams preferably extending vertically of the cushion, and of the wearer, so the cushion of the present invention tends to lie close to the body of the wearer. In one embodiment of the invention, the cushion of the present invention includes a message slot for selective display of a slogan or other message chosen by the wearer.

BRIEF DESCRIPTION OF THE DRAWINGS

These and other features and advantages of the present invention will become apparent from consideration of the following specification when taken in conjunction with the accompanying drawings in which:

FIG. 1 is a perspective view showing a cushion made in accordance with the present invention;

FIG. 2 is an enlarged, cross-sectional view taken substantially along the line 2—2 in FIG. 1;

FIG. 3 is an enlarged, cross-sectional view taken substantially along the line 3—3 in FIG. 1;

FIG. 4 is a front elevational view showing the side of the cushion opposite from that shown in FIG. 1; and, FIG. 5 is a rear elevational view showing the cushion of FIG. 1 attached to a person.

DETAILED DESCRIPTION OF THE EMBODIMENT

Referring now more particularly to the drawings, and to that embodiment of the invention here presented by way of illustration, FIG. 1 shows a cushion generally designated at 10 having a central body portion designated at 11 with a lower bifurcated end 12 and an upper, message display area 14. It will be understood that the upper end 14 will lie substantially at the wearer's waist, and the straps 15 and 16 will pass around the wearer to hold the upper end of the cushion to the person's waist, or thereabout. The body 11 of the cushion 10 will cover generally the buttocks of the person; and, the bifurcated end 12 will extend somewhat onto the legs of the wearer. Straps 18 and 19 can fix the bifurcated end to the legs of the wearer.

Looking at the construction of the cushion in more detail, it will be seen that the body 11 has a plurality of vertical seams 20, the seams 20 adhering a back and front panel together so the cushion 10 can be filled with air without rendering the cushion unmanageable.

Looking at FIG. 2 of the drawings, it will be seen that there is a front panel 21 and a back panel 22. The two panels are adhered to each other at edge seams 24, and the central area of the panels is adhered along lines by the seams 20.

While many variations in the configuration of the seams 20 will work quite well to seal the front and back panels 21 and 22 together, it is important that the seams 20 extend somewhat vertically as opposed to horizontally. If the seams 20 are parallel lines extending horizontally, the cushion 10 will bend easily, using the seams as folding lines so that the cushion tends to extend outwardly of the wearer's body. This is both unsightly and uncomfortable. On the other hand, with the seams 20 extending generally vertically, it will be understood that the tendency of the cushion 10 is to fold about the seams 20, which renders the cushion curved in the opposite direction. The cushion therefore lies closer to the body of the wearer.

The lower, bifurcated portion 12 of the cushion 10 includes a crotch opening 25, and leg portions 26 and 28. It is contemplated that the crotch opening 25 will substantially coincide with the crotch of the wearer so the leg portions 26 and 28 will extend somewhat to cover the legs of the wearer. When a person sits, the person sits on the pelvic area, but much of the weight is supported by the upper thighs of the person. Thus, for true comfort, a cushion must cover the upper thighs of the person, and the leg portions 26 and 28 perform this service. Also, each of the leg portions 26 and 28 carries straps 18 and 19 for attachment of the cushion 10 to the legs of the wearer.

From the foregoing discussion it will be realized that the straps 15 and 16 will fix the upper portion 14 of the cushion 10 to the wearer, substantially in the area of the wearer's waist. The straps 18 and 19 will then fix the bifurcated portion 12 to the wearer's legs. The cushion 10 is therefore held both at its top and at its bottom, so the cushion is well anchored in position.

The cushion 10 is preferably made of a plastic sheet material that is reasonably elastic so that the cushion 10 is readily bendable to allow normal activity of the wearer. While many materials will work quite well, the readily available 20 mil vinyl is frequently used in the manufacture of cushions and the like, and works quite well for cushions made in accordance with the present invention. Other materials such as polyethylene will work quite well, and can be used in thinner gauges because of the greater strength. For comfort, it is contemplated that the front panel 21 will have a velvety, or flocked, surface. This is indicated in FIG. 4 by the stippling. While such a surface is optional, it will improve the feel of the material.

Looking now at FIGS. 1 and 3 of the drawings, the upper area 14 of the cushion 10 is also formed primarily of the front panel 21 and rear panel 22. The two panels are sealed at the horizontal line designated at 29, and there is an upper, edge seam 24. As illustrated in the drawings, the upper area 14 is also inflatable, so this inflated area can provide comfort for the wearer's lower back, and perhaps some support. It will be readily recognized, however, that the area 14 could be sealed off from the body 11 so that the area 14 would not be inflated. The body portion 11 and bifurcated portion 12 would still provide substantial comfort for the wearer.

FIG. 3 also shows the message slot 33 in the present invention. As is illustrated in FIG. 1, there is a message designated at 30, the message being printed on material 31 which is covered by a transparent sheet 32. As is best shown in FIG. 3 of the drawings, the transparent sheet 32 is a separate piece heat sealed at 29 and 24 to form the slot 33. The sheet 32 then includes slits 34 and 35 to allow the material 31 to be inserted into and removed from the slot 33.

FIG. 4 of the drawings shows the front, or inside, of the cushion 10, and it will be seen that the upper portion 14 includes seams 20*a* generally aligned with the seams 20. As is known in the art, the plurality of seams such as the seams 20 and 20*a* are utilized to prevent the cushion from becoming generally spherical, so the seams maintain the cushion in a substantially flat configuration.

Also in FIG. 4 there is shown an inflation valve 36 for inflating the cushion 10. With a cushion such as that shown in the drawings, it is contemplated that a valve 36 will be designed for inflation by mouth, though of course any other form of valve can be utilized as desired.

With the foregoing in mind, it will be understood that the cushion of the present invention can be inflated through the valve 36 to the desired degree of softness or comfort. The cushion 10 can then be placed in the desired position on the wearer's buttocks, and the straps 15 and 16 passed around the person's body. The straps 15 and 16 include strips of hook and loop fasteners, or other fastening means, so the upper portion 14 of the cushion 10 can be fixed with respect to the body of the wearer. The bifurcated portion 12 will then be urged against the person's legs, and the straps 18 and 19 will be fastened around the person's legs. The straps 18 and 19 will also include hook and loop fasteners if desired, or other fastening means. With the cushion inflated, and the cushion strapped to the body of the person, the cushion will remain in place with respect to the body of the wearer so the cushion is always in place when the person sits down. Furthermore, by use of the message slot 33 it will be understood that any desired message can be displayed when the person stands. Thus, at football games or the like, any time a person stands to cheer his team, he might display some appropriate slogan or cheer. Obviously, the message can be varied for the activity, used for commercial advertising or statement of other personal feelings or opinions. The slot 33 can be sized to receive conventional bumperstickers or other readily available material.

It will also be noticed in FIG. 4 of the drawings that there are additional slits 38. These slits can be used for additional belts or straps if desired, or can be omitted if it is felt that they are unnecessary.

It will therefore be understood by those skilled in the art that the particular embodiment of the invention here presented is by way of illustration only, and is meant to be in no way restrictive; therefore, numerous changes and modifications may be made, and the full use of equivalents resorted to, without departing from the spirit or scope of the invention as outlined in the appended claims.

I claim:

1. A seat cushion comprising a body portion for receipt generally over the buttocks of a user, an upper portion for disposition generally at the waist of the user and having a width substantially equal to the width of said body portion, and a lower bifurcated portion, said bifurcated portion defining a crotch opening and including leg portions, said crotch opening being normally disposed at he crotch of the user with said leg portions extending over the upper thighs of the user, and strap means for holding said seat cushion in place on the user, said cushion including a front panel and a back panel, seams for attaching said front panel to said back panel, and a valve for filling said cushion with fluid, and further including a plurality of said seams distributed throughout said body, said plurality of said seams extending generally vertically of said body and of said user, in the direction from said upper portion to said lower portion, and further including a transparent sheet fixed to said cushion at said upper portion and defining a single slot between said transparent sheet and said cushion, said slot having a width substantially equal to the width of said upper portion and being adapted to receive a sheet of printed material so that said sheet of printed material is disposed generally at the waist of the user, said transparent sheet defining at least one vertically extending slit for receiving the sheet of printed material through said slit and into said slot.

2. A seat cushion as claimed in claim 1, said strap means including first straps fixed to said upper portion of said seat cushion and of sufficient length to pass around the waist of the user, and second straps fixed to said leg portions and of sufficient length to pass around the thighs of the user, said front panel including flocking throughout.

* * * * *